US009637367B1

(12) United States Patent
Arnold

(10) Patent No.: US 9,637,367 B1
(45) Date of Patent: May 2, 2017

(54) COMBINED CORK AND TWIST CAP REMOVER

(71) Applicant: Karl Peter Arnold, Herndon, VA (US)

(72) Inventor: Karl Peter Arnold, Herndon, VA (US)

( * ) Notice: Subject to any disclaimer, the term of this patent is extended or adjusted under 35 U.S.C. 154(b) by 318 days.

(21) Appl. No.: 14/581,805

(22) Filed: Dec. 23, 2014

Related U.S. Application Data

(60) Provisional application No. 61/922,084, filed on Dec. 30, 2013.

(51) Int. Cl.
*B67B 7/04* (2006.01)
*B65D 39/16* (2006.01)
*B67B 7/08* (2006.01)

(52) U.S. Cl.
CPC ..... *B67B 7/0405* (2013.01); *B65D 39/16* (2013.01); *B67B 7/08* (2013.01)

(58) Field of Classification Search
CPC ..... B67B 7/0405; B67B 7/08; B65D 39/16
See application file for complete search history.

(56) References Cited

U.S. PATENT DOCUMENTS

| | | | | |
|---|---|---|---|---|
| 504,293 | A | 8/1893 | Bailey | |
| 649,849 | A | 5/1900 | Lang | |
| 2,599,968 | A | 6/1952 | Acard | |
| 2,897,699 | A | 8/1959 | Anderson, Jr. | |
| 3,909,860 | A | 10/1975 | Cantales | |
| 3,939,860 | A | 2/1976 | Golding | |
| 4,637,283 | A | 1/1987 | Bertram et al. | |
| 4,955,261 | A | 9/1990 | Chiang | |
| 5,079,975 | A | 1/1992 | Spencer, Jr. | |
| 5,095,778 | A | 3/1992 | Bocsi et al. | |
| 5,351,579 | A | 10/1994 | Metz et al. | |
| 5,365,806 | A | 11/1994 | Paramest | |
| 5,372,054 | A | 12/1994 | Federighi, Sr. | |
| 5,503,047 | A | 4/1996 | Brockington | |
| 5,724,869 | A | 3/1998 | May | |
| 6,101,899 | A | 8/2000 | Nikolic | |
| 6,321,620 | B1 | 11/2001 | Fabbro | |
| 6,752,041 | B2 | 6/2004 | Lee | |
| 6,862,954 | B2 | 3/2005 | Dubois et al. | |
| D504,293 | S | 4/2005 | Allan | |
| 7,234,375 | B1 * | 6/2007 | Wang Wu | B67B 7/08 81/3.2 |
| 7,398,714 | B1 | 7/2008 | Mah et al. | |
| 7,775,140 | B2 | 8/2010 | Chan | |
| D657,643 | S | 4/2012 | Mah et al. | |
| 8,578,819 | B2 | 11/2013 | Cheung | |
| 2004/0250656 | A1 | 12/2004 | Tremblay | |

FOREIGN PATENT DOCUMENTS

| | | |
|---|---|---|
| WO | 9118822 | 12/1991 |

* cited by examiner

*Primary Examiner* — David B Thomas
(74) *Attorney, Agent, or Firm* — Dowell & Dowell, PC

(57) ABSTRACT

A hand-held container opener for providing a convenient way to open both containers with a twist-off cap and containers with a cork-stopper which includes a caliper clamp assembly mounted within a first open end of a housing and which is driven by a motor to initially clamp and subsequently twist off a cap on a container and which includes a second open end portion that includes a cork-screw driven by the motor or gas injection device for penetrating a cork for either twisting the cork from the container using the corkscrew or forcing the cork from the container using pressurized gas.

14 Claims, 10 Drawing Sheets

COMBINED CORK AND TWIST CAP REMOVER

BACKGROUND OF THE INVENTION

Field of the Invention

This patent relates to hand-held devices such as openers designed and intended for two main purposes. The first is to remove a screw or twist cap or lid from a container which is designed to be closed by the cap or lid, and second, to remove a cork, or like stopper, from a container that is designed to receive and be closed by the cork or stopper. The containers can be any bottle or jar that is sealed by either a screw or twist cap or lid or a cork or similar sealing plug or stopper and may be used to retaining liquid and/or solid products including comestible and other products.

Brief Description of the Related Art

People have been removing caps and corks from bottles and other containers for years. In many cases, the cap or the cork is sealed by a bottler once contents have been placed inside. Often, caps and corks are difficult to remove manually. Often, twist or screw type caps or lids almost become sealed to containers requiring the use of torque applying tools, mechanical tapping or the application of heated water to break the sealed to enable the caps or lids to be removed by hand. Because of this, various innovations have been made to provide electronically powered devices to facilitate cap and cork removal from bottles and other containers.

By way of example, U.S. Pat. No. 5,079,975 to Spencer, J R (1992), discloses a corkscrew apparatus which is able to extract a cork from a bottle as well as reinsert a cork back into the bottle. The apparatus has an extraction tube which fits over a mouth of the bottle when a bottle is inserted into the apparatus. When the apparatus is turned on, a reversible motor turns in a first direction that turns an auger so as to extend axially through the extraction tube. The auger is then rotated into a cork within the bottle. As the auger advances into the cork, a shoulder formed on an inside of the extraction tube engages an upper end of the bottle. Once the shoulder of the extraction tube reaches the upper end of the bottle, the auger will extract the cork from the bottle into the extraction tube.

In U.S. Pat. No. 5,351,579 to Metz et al. (1994), a device is disclosed having an automatic corkscrew, which can stand upright. Such a device incorporates a detachable cutting device that mounts onto a base of a housing and adds stability when the device is in an upright position. The device is powered by a rechargeable battery, which is used to drive a reversible motor. The motor drives an auger, which is used to remove a cork from a bottle. When the device is turned on, the process to remove the cork from a bottle begins. The battery powers the reversible motor, which turns the auger. The device uses a cork removal mechanism for retaining the cork when extracted from bottle. The cork removal mechanism includes a cork holder that slides along the housing of the device. A button is used to hold the cork stationary allowing the auger to rotate relative to the cork for extraction. The rotation of the auger causes the auger to enter the cork and thereafter extract the cork from the bottle.

U.S. Pat. No. 6,679,138B2 to Battles et al (2004), discloses a cap removing device having an opening to receive a bottle cap. The device includes a top, a base and two opposing annular members which, when used in the operation of the device, grip the sides of a bottle cap after which the bottle cap can be twisted off of a container. In addition, the device has a crimped bottle cap removal system, cams, bushings and torsion springs that provide increased gripping force on a bottle cap. The device is used to remove the bottle cap from the container or bottle and is designed in such a way that the top and base provide leverage for the user to reduce hand stress on the user when twisting the bottle cap off.

In U.S. Pat. No. 6,477,920 to Yang (2002), a cork removal apparatus is disclosed including a press-in member, both exterior and interior barrels, a chamber to accept a bottle and a needle fixed at the bottom of the interior barrel. The needle includes an inlet for gas, a passageway for gas and an exit way for gas. Within the interior barrel of the cork removal apparatus is a compartment for a gas container. To operate, a user places a gas container into the interior barrel, places a bottle with a cork into the chamber of the apparatus, and aligns the sharp tip end of the needle downward onto the top of the cork. The user then pushes the apparatus downward, which in turn pushes the needle until it penetrates the cork. With this downward motion the needle is driven through the cork and extends past the opposite side of the cork exposing the discharge opening of the needle. A press-in member can force gas from the gas container to flow through the needle into the bottle to extract the cork upward from the bottle for a safe removal of the cork.

Lastly, referring to U.S. Pat. No. 6,971,282 to Bathey (2005), a lid torqueing device is described which may be used to assist in the removal of a lid from a container. Such a device can also be used to tightening the lid onto a container. The device has a housing having an engagement surface with an opening slot which is sized and configured to accommodate at least a portion of the lid. A moveably mounted member with pivoting action is joined with a spring to adjust the slot size based on the size of bottle lid. When a container has a lid to be remover, the user simply holds the device over the bottle placing the lid into the device slot. The mounted member with pivoting action will adjust to the size of the lid for a tight grip. The user then turns the entire device creating torque, which removes the lid.

Today when a user wants to open a bottle having a cork stopper, they can use a manual cork-driving device to remove the cork from the bottle. An alternative is to use an electrically charged and/or battery driven corkscrew to remove the cork from a bottle. However, what happens when a user needs to open a bottle of beverage, particularly ones with a long neck or even a short neck. For most cases, they hold a bottle and use their hands to tightly grip the bottle cap and twist in order to release or break the seal placed during the bottling process. Often a person will use a vice grip, gripping tool or other devices designed to create leverage wherein the person uses their hand to grip the device which grips the bottle cap. The use of such devices creates torque and gives leverage to the user to twist off the bottle cap from a bottle.

SUMMARY OF THE INVENTION

The present invention is directed to an improved combination cork-stopper and twist cap remover which has several advantages in the removal of both bottle caps from bottles as well as cork stoppers from bottles while being a single hand held device.

An improvement to the noted inventions above is a combined cork and twist cap remover which has the advantage of being convenient and efficient in the task of releasing and removing both a bottle cap from a bottle as well as a cork stopper from a bottle. The improved combined cork and twist cap remover has a motor and power source used in conjunction with at least one gear system to remove cork stoppers and twist bottle caps from bottles. In each of the embodiments of the invention, a hand held housing is provided having a first open end portion of a size to be seated over a container, such as a bottle, closed by a twist off cap or lid. The motor is connected through drive gears to a caliper clamp assembly having a pair of opposing clamps that are movable toward one another to initially engage a cap and which thereafter apply force to twist the cap or lid to thereby release the cap or lid from a container. The combined cork and twist cap remover is unlike prior art openers in that the housing defines a second open end portion adapted to be seated over a neck of a bottle closed by a cork or stopper-like seal or structure.

In a first embodiment of the invention, the second open end portion is associated with a corkscrew which is also connected by drive gears to the motor. By selective operation of a power switch after the second end portion is seated over a cork or stopper sealing a bottle, the motor drives the corkscrew so that it penetrates the cork and pulls it from the bottle. By operating the power switch to operate the motor in a reverse direction, the cork or stopper is urged from the corkscrew. In a first version of the first embodiment, the first and second open end portions of the housing are oppositely oriented along a central axis of the housing. In a second variation of the first embodiment, one of the first and second open end portions is oriented transversely relative to the central axis of the housing such as between 10 to 90 degrees for example. In a third variation of the first embodiment, the first and second open end portions are oriented in side-by-side and in generally parallel relationship relative to one another and opening in the same direction.

In another embodiment of the invention, as opposed to having the second end portion of the housing enclosing a corkscrew, a pressure chamber and an injector needle are housed within the second end portion. With this embodiment, a cork or stopper is removed from a bottle or similar container using gas pressure. By placing the second end portion to the housing of the combined cork and twist cap remover over the corked end of the bottle, the needle is urged through the cork and by subsequent operation of a control switch, pressure from the pressure source is conveyed into the bottle to urge the cork from the neck of the bottle. In this embodiment of the invention, the second end portion may be oriented transversely or parallel to the first end portion as previously described.

BRIEF DESCRIPTION OF THE DRAWINGS

A better understanding of the invention will become apparent with reference to the accompanying drawings wherein.

DESCRIPTION OF THE PREFERRED EMBODIMENTS

Figure 1:
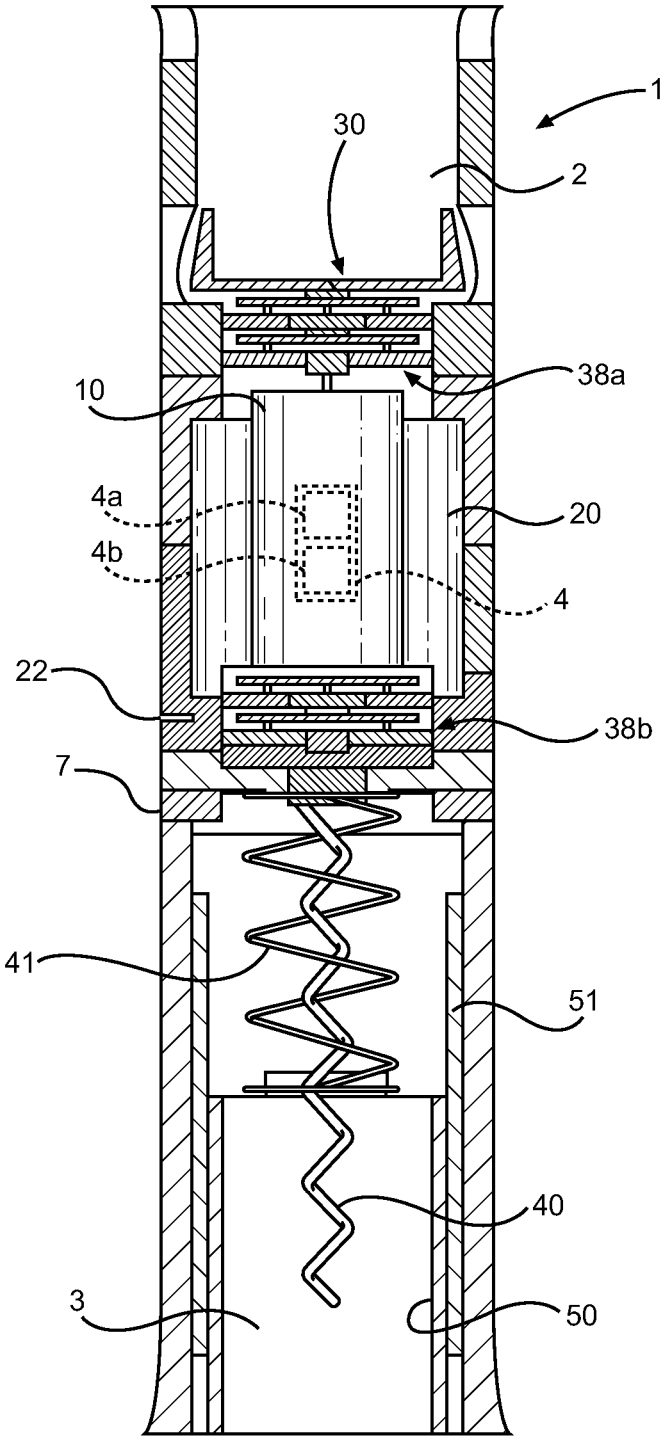
FIG. 1 is a cross sectional view of a combined cork and twist cap remover in accordance with the invention.

With continued reference to the drawing figures, FIG. 1 is a front cross sectional view looking into a body of a first embodiment of a combined cork and twist cap remover (1) having a housing member (7) having a first open end portion defining a twist cap remover portion (2) and an opposite or second open end portion defining a corkscrew portion (3). The combined cork and twist cap remover has a battery source (20) and switch (4) used to put in motion a motor (10) which is attached to power two planetary gear systems (38*a* and 38*b*). Mounted within the upper twist cap remover portion of the housing is a caliper clamp assembly (30) having a pair of adjustably movable arcuate cap engaging jaws or clamps (31*a* and 31*b*). The caliper clamp assemblies will be described in more detail with reference to FIGS. 2, 9, 9*a* and 9*b* and FIGS. 10, 10*a* and 10*b*. Also included is a corkscrew (40) used to release a cork, or like stopper, from a bottle and a spring (41) for interacting with a retracting tube (50) in which a cork is retained when removed by the corkscrew from a neck of a bottle or like container as will be described in greater detail hereinafter.

Figure 2:
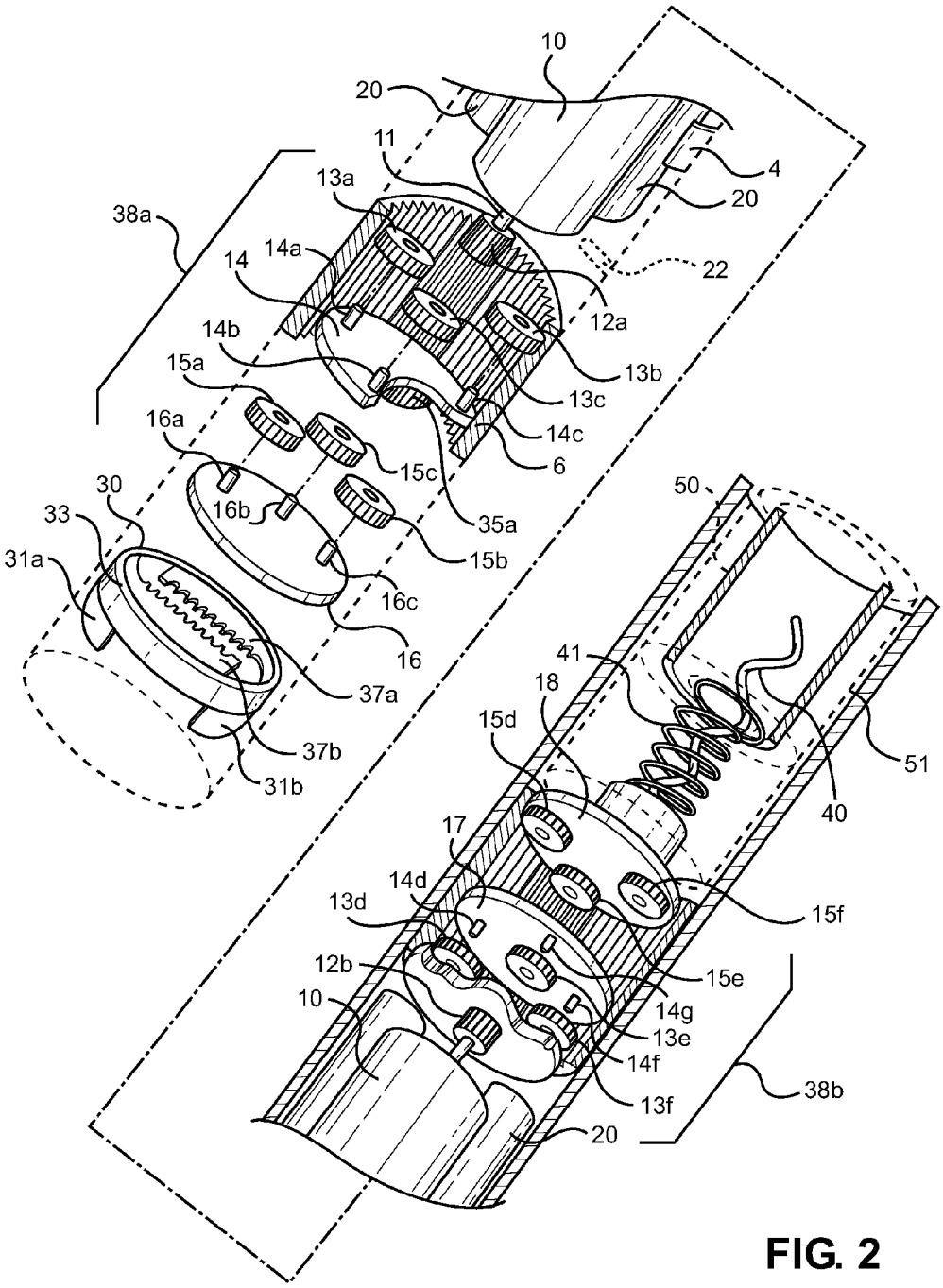
FIG. 2 is an exploded view of the combined cork and twist cap remover shown in FIG. 1.

FIG. 2 is an exploded view of the combined cork and twist cap remover (1), which is powered within the housing member (7) by an internal power source (20). The power source (20) may be rechargeable batteries which receive charging power through a receiving unit (22) connect to a charging cord or stand which can be used to connect to an external power source such as an AC outlet source. The power source may also be replaceable batteries. The power source (20) powers the motor (10) which, in the embodiment of the combined tool of FIGS. 1-4, has a pair of generally axially aligned drive shafts (11*a* and 11*b*) with two drive gears (12*a*) and (12*b*) mounted thereto. The switch (4) includes buttons (4*a*) and (4B). When button (4*a*) is engaged, the motor (10) rotates the drive shafts in a first direction. By engaging button 4(*b*), the drive shafts will turn the drive shafts in an opposite or reverse direction.

The drive gears (12*a*) and (12*b*) are engaged to rotate the planetary gear systems or assemblies (38*a*), and (38*b*). The planetary gear assembly (38*a*) has planetary gears (13*a*), (13*b*) and (13*c*). These planetary gears (13*a*), (13*b*) and (13*c*) when turned on will turn along the inner elongated wall teeth (6) formed along the inner surface of an inner compartment wall (21) of the planetary gear assembly. Planetary gears (13*a*), (13*b*) and (13*c*) turn on gear axles (14*a*), (14*b*) and (14*c*) which are mounted on planetary platform (14). Planetary platform (14) has a sun planetary gear (35*a*) at the bottom. The sun planetary gear (35*a*) is mounted on the bottom of planetary platform (14) which turns planetary gears (15*a*), (15*b*) and (15*c*) which turn on gear axles (16*a*), (16*b*) and (16*c*) which are mounted on planetary platform (16). The planetary gears (15*a*), (15*b*) and (15*c*), when in motion, will also turn along the inner wall teeth (6).

Figure 9A:
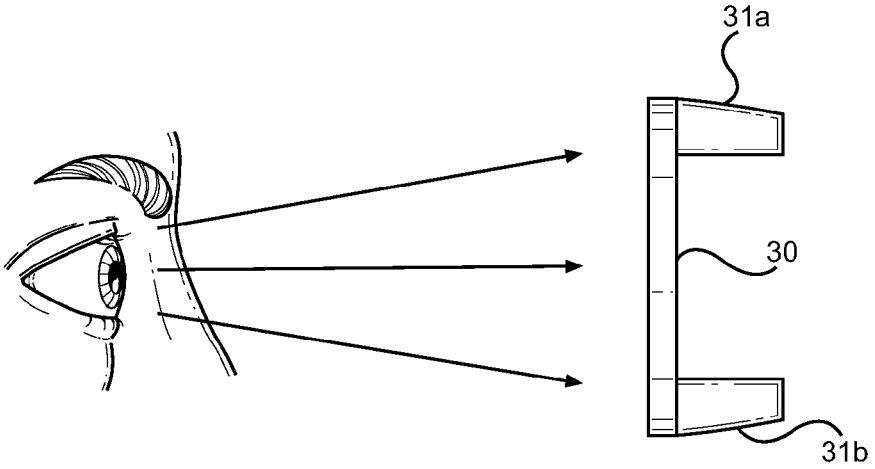
FIG. 9A is a side looking at a caliper clamp assembly such as shown in FIG. 1.
Figure 9B:
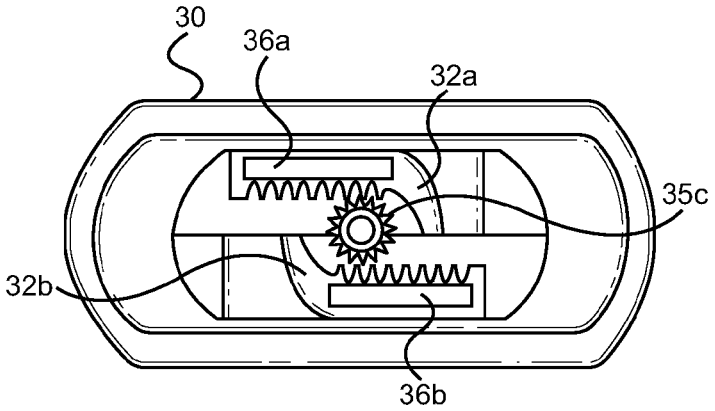
FIG. 9B is a top plan view of the caliper clamp of combined cork and twist cap remover shown in FIG. 9A showing lid engaging clamps being adjusted toward one another.
Figure 9C:
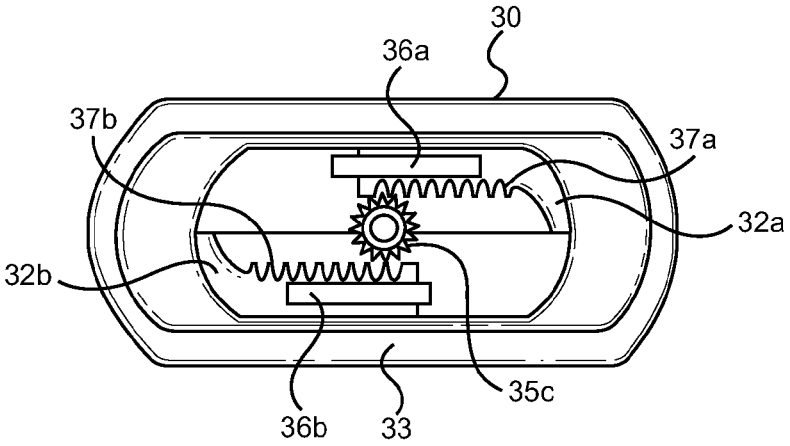
FIG. 9C is a view similar to FIG. 9B showing the opposed clamps being moved to an open position relative to one another.

Planetary platform (16) also has a planetary gear (35*c*), see FIGS. 9A, 9B and 9C, at the bottom which engages with caliper teeth (37*a*) and (37*b*) of a pair of slide members (32*a* and 32*b*) movably mounted to a caliper base (33) which are part of a caliper clamp assembly (30). Motor drive shaft gear (12*b*) connects to planetary gears (13*d*), (13*e*) and (13*f*). These planetary gears (13*d*), (13*e*) and (13*f*) when driven in either direction will turn along elongated teeth (6') of the inner compartment wall (21') of planetary gear assembly (38*b*). Planetary gears (13*d*), (13*e*) and (13*f*) turn on gear axles (14*d*), (14*e*) and (14*f*) which are mounted on planetary platform (17). Planetary platform (17) has a sun planetary gear (not shown) mounted at the bottom. The sun planetary gear turns planetary gears (15*d*), (15*e*) and (15*f*) which turn on three gear axles (not shown) which are mounted on planetary platform (18). The planetary gears (15*d*), (15*e*) and (15*f*) when in motion will turn along the teeth (6) of inner compartment wall of planetary gear assembly (38*b*). Planetary platform (18) also has a sun planetary gear (not shown) at the bottom which drives corkscrew (40). The corkscrew (40) works with retracting tube (50) which secures a cork when extracted from a bottle. Such retracting tube (50) slides along members (51) acting as guides. A spring (41) is used to retract the retracting tube (50) when in a non-use state.

Figure 3:
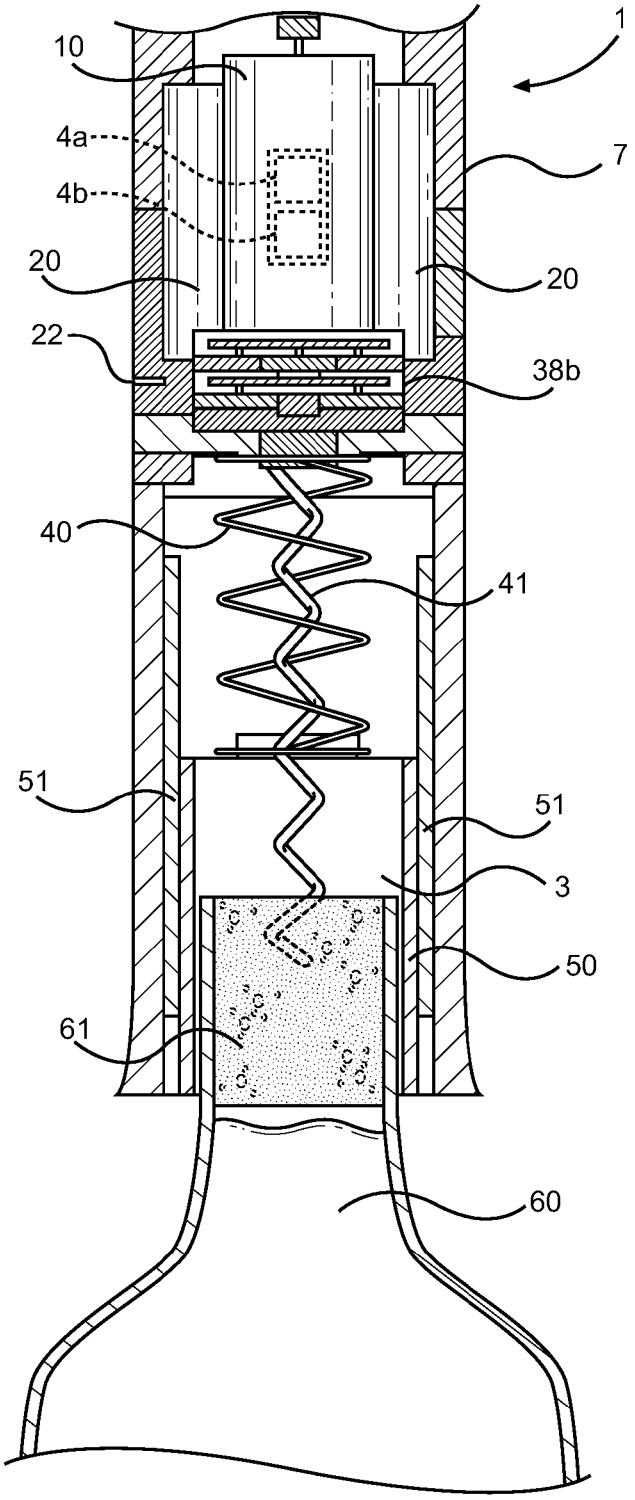
FIG. 3 is a partial cross sectional view of the combined cork and twist cap remover of FIG. 1 showing a corkscrew being driven into a cork in a bottle.

FIG. 3 is a partial cut away from a top portion of the combined cork and twist cap remover (1), as outlined in FIG. 1. The cut away view has omitted the other cap engaging portion of the combined cork and twist cap remover, which will perform the twist cap removing function of the device. Here we have a bottle (60) closed by a cork (61). As the corkscrew (40) is inserted into cork (61) the retracting tube (50) slides along guide members (51) and the cork is pulled upwardly from the neck of the bottle and into the tube (50). The spring (40) is used to retract the retracting tube (50) when in a non-use state.

Figure 4:
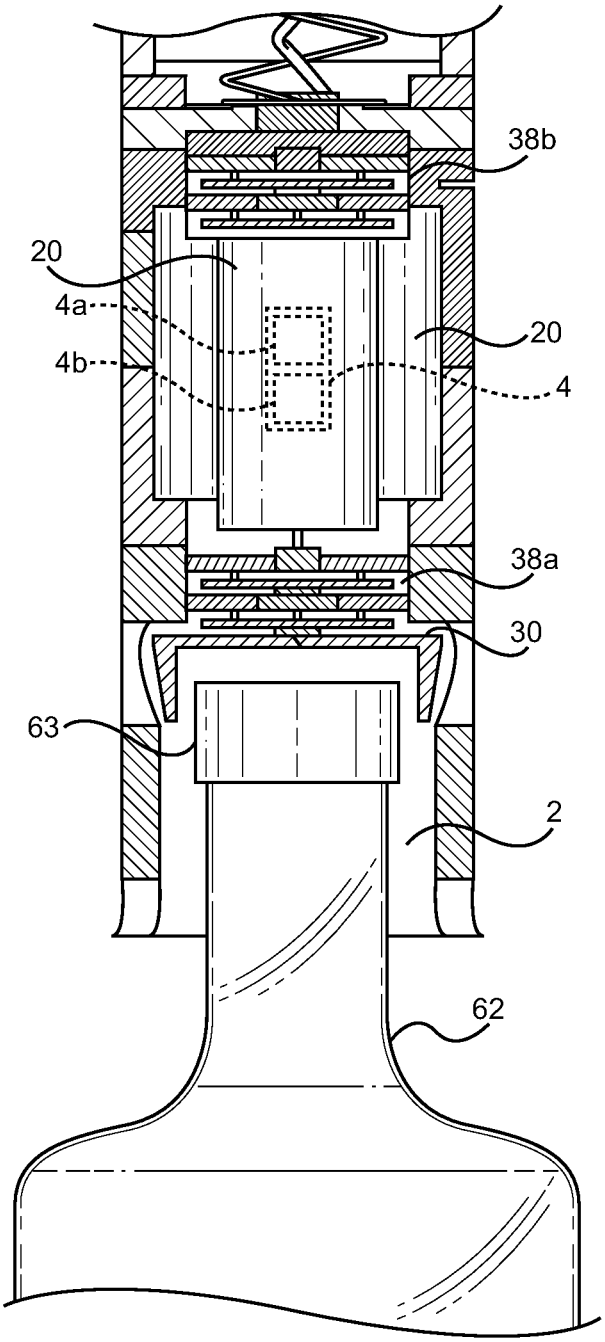
FIG. 4 is a partial cross sectional view of the combined cork and twist cap remover shown in FIG. 1 showing the twist cap remover for removing a cap from a bottle.

FIG. 4 is a partial cut away from the bottom view of the combined cork and twist cap remover (1) of FIG. 1. That is, the top that includes the corkscrew is not shown. What is shown is a twist cap bottle (62) with a twist cap (63), and the caliper clap assembly (30) used to aid in the releasing of the twist cap from the twist cap bottle. The twist cap may be threaded to threads (not shown) on the neck of the bottle or the twist cap may be otherwise secured or sealed to the bottle but is designed to be released by a twisting or rotational motion relative to an elongated vertical axis of the bottle. The manner in which the caliper clamp assembly (30) functions is shown in greater detail in FIGS. 9A, 9B, 9C, 10A, 10B and 10C. FIG. 9A is a side view looking at the caliper clamps (31*a* and 31*b*) of the caliper clamp assembly (30) from the bottom of the combined cork and twist cap remover (1). The clamps are movably adjustable within the caliper base (33) and are connected to the slides members (32*a* and 32*b*) so that they can be moved apart or urged toward one another in order to engage a lid or cap of a container there between as shown in FIG. 3. The clamps have opposing concavely arcuate curved walls for engaging the outer arcuate edges of a cap or lid.

Figure 10A:
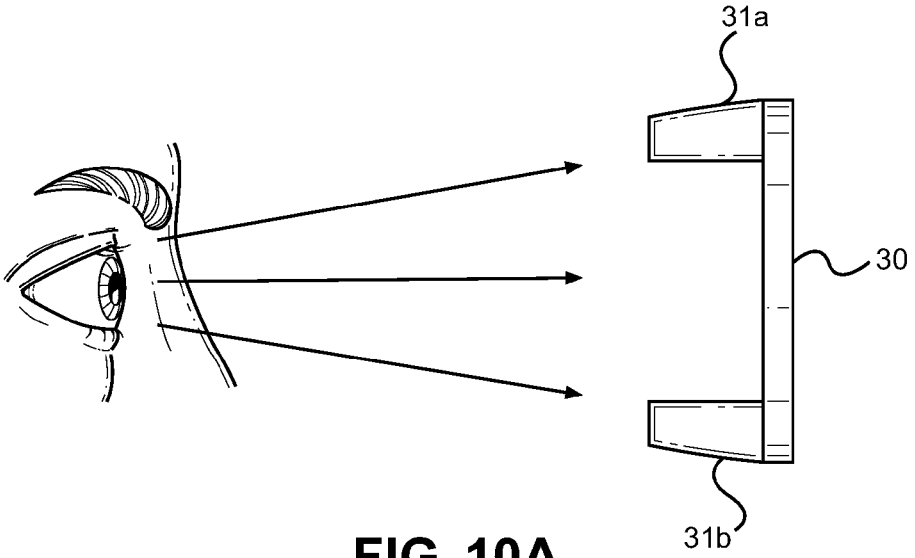
FIG. 10A is a side view looking at the caliper clamp assembly of FIG. 1.
Figure 10B:
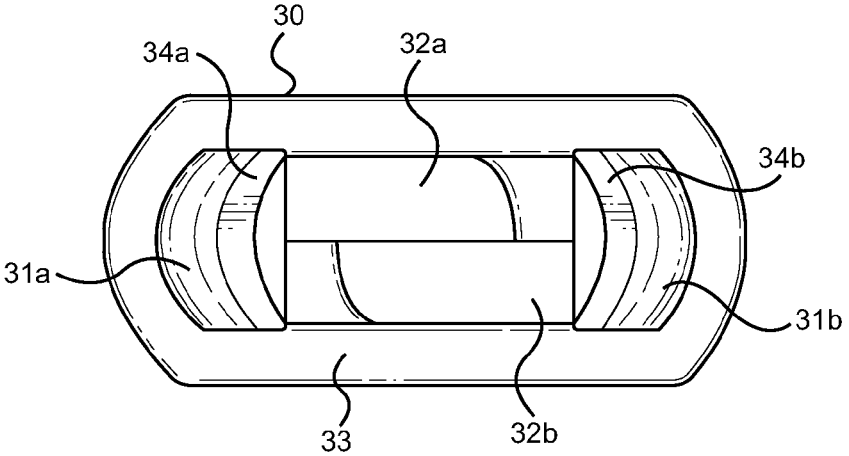
FIG. 10B is a bottom plan view of the caliper clamps of the combined cork and twist cap remover with the clamps closed relative to one another.
Figure 10C:
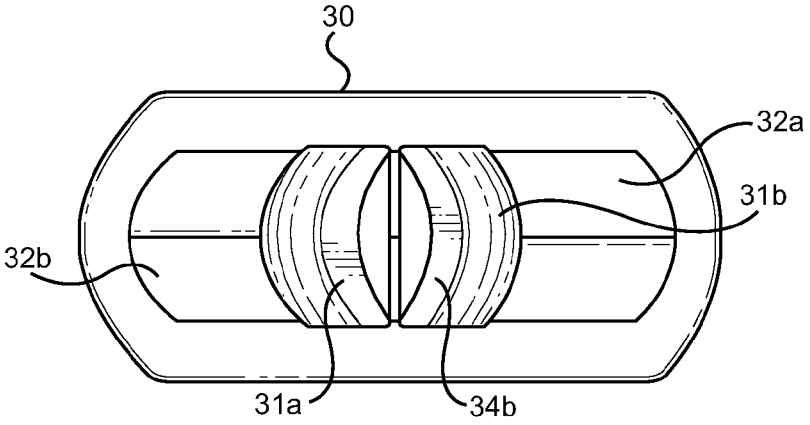
FIG. 10C is a bottom close view at the caliper clamps of the combined cork and twist cap remover with the clamps shown in open and spaced relationship with respect to one another.

As shown in FIGS. 4 and 10B, the clamps are spaced apart so that the first end portion of the combined cork and twist cap remover may be placed over the cap or lid of a bottle. Thereafter, by pressing the switch button (4*a*), the motor drives the sun gear (35*c*) which meshes with the teeth (37*a* and 37*b*) of the slide members thereby moving the slide members from the position shown in FIGS. 9B and 10B toward the closed position shown in FIGS. 9C and 10C. As the clamps engage the cap or lid of the bottle, continued operation of the motor will cause the caliper clamp assembly to rotate the cap or lid thus freeing the cap or lid from the bottle. By engaging switch button (4*b*) the motor is driven in reverse such that the clamps move apart to release the cap or lid.

In an alternate variation of the embodiment shown in FIG. 4 and as shown in FIGS. 9B and 9C which are top views of the slide members of the caliper clamp assembly (30). Caliper springs (36*a* and 36*b*) may be attached to the slide members (32*a* and 32*b*) to continuously urge the slide members to the open position thereof shown in FIGS. 9B and 10B when the motor is not operated.

Figure 5:
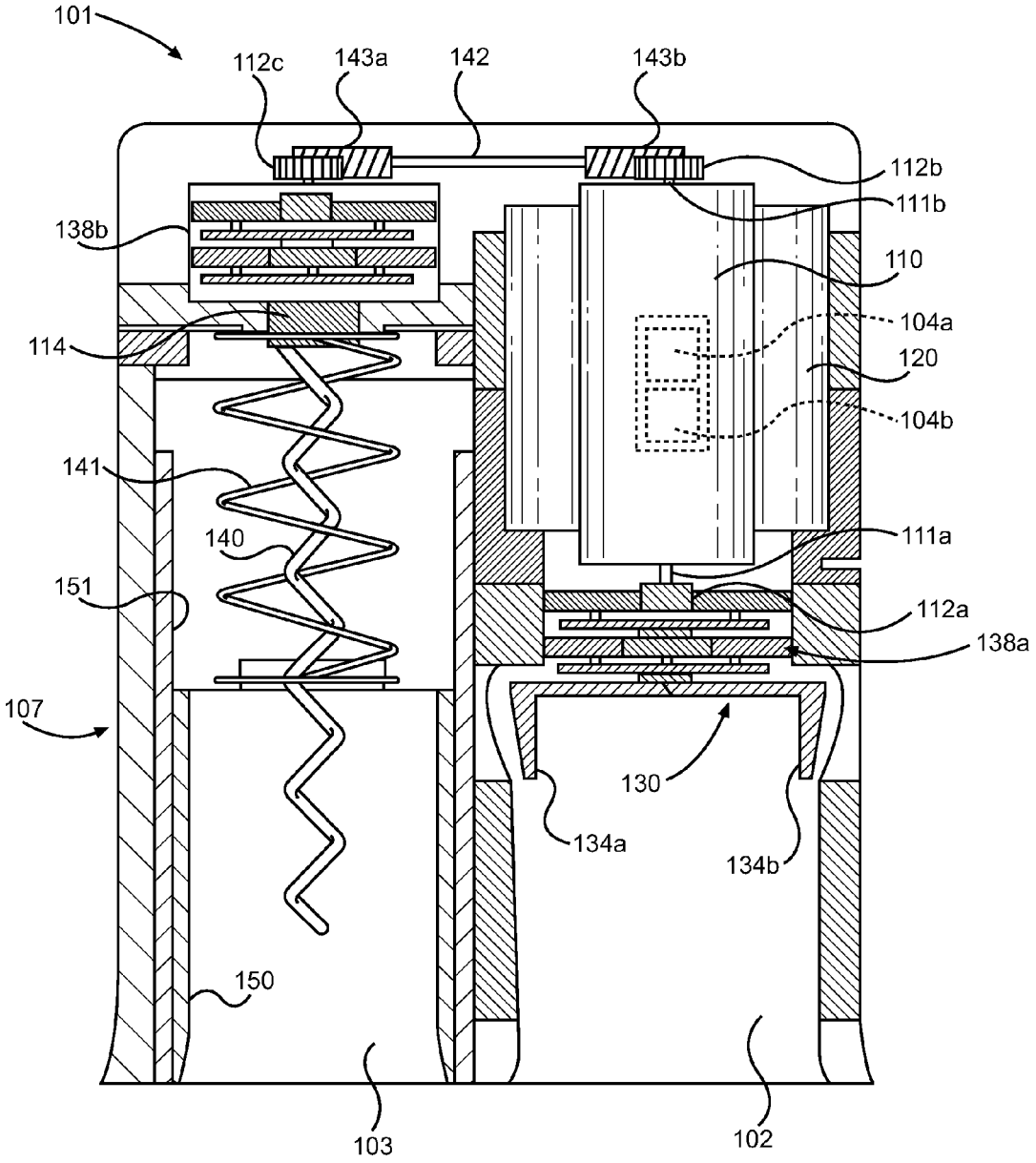
FIG. 5 is a cross sectional view of combined cork and twist cap remover in alternate side-by-side configuration.

FIG. 5 is an alternate embodiment of the combined cork and twist cap remover as outlined in FIG. 1. The elements in common with the embodiment of FIG. 1 are referenced by reference numbers raised by 100. In this embodiment the combined cork and twist cap remover (101) has a housing (107) including a corkscrew portion (103) of a size to be seated over the neck of a container, such as a bottle having a neck closed by a cork or like stopper, and twist cap remover portion (102) of a size to be seated over a container closed by a twist cap. The two portions of the housing are shown in side-by-side and generally parallel relationship to one another. There is motor (110) and a battery or other power source (120) connected to the motor through switch (104) similar to the one previously described and thus having forward and reverse buttons (104*a* and 104*b*). The motor includes a pair of drive shafts (111*a* and 111*b*). Drive shaft (111*a*) is connected by way of drive gear (112*a*) to drive a planetary gears system (138*a*) connected to drive a caliper clamp assembly (130) including a pair of movably adjustable arcuate clamps (134*a* and 134*b*), in a manner as described with respect to the embodiment of the invention shown in FIGS. 1-4. In this embodiment, the second drive shaft (111*b*) drives a drive gear (112*b*) which drives a gear shaft (142) through worm gear 143*b*. The gear shaft also engages a driven worm gear (143*a*) that meshes with input gear 112*c* which drives the gears of a planetary gears system (138*b*), similar to the planetary gear systems of the first embodiment. The planetary gear system (138*b*) is connected to drive output corkscrew drive shaft (114) to which a corkscrew (140) is mounted. In this embodiment the corkscrew (140) works with retracting tube (150) which secures a cork when extracted from a bottle. Such retracting tube (150) slides along members (151) acting as guides. A spring (141) is used to retract the retracting tube (150) when in a non-use state.

Figure 6:
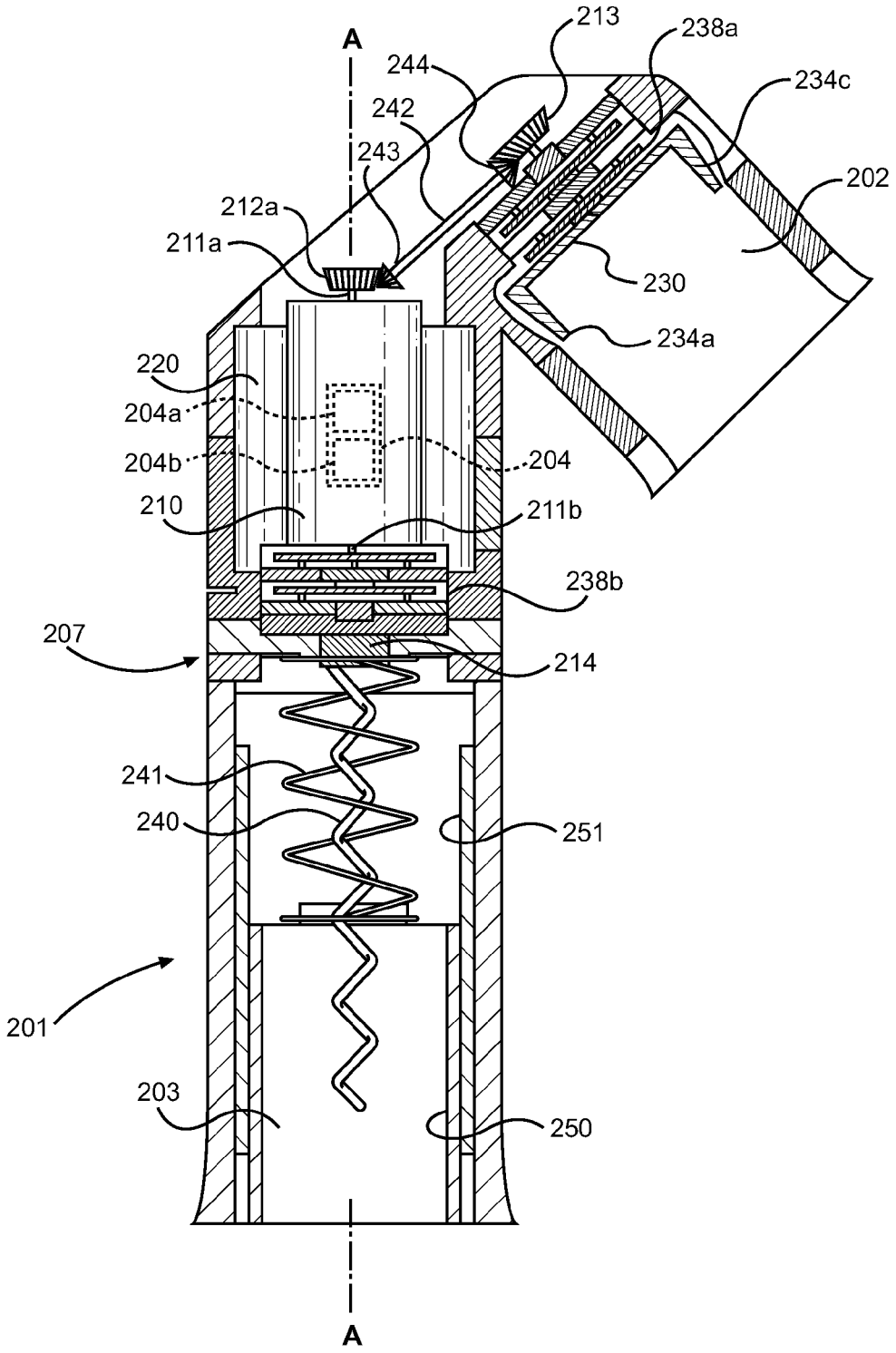
FIG. 6 is a cross sectional view of combined cork and twist cap remover in alternate arched or angled configuration.

FIG. 6 is another alternate arched top or angular variation of a combination cork and twist cap remover (201) of the invention. The elements in common with the embodiment of FIG. 1 are referenced by reference numbers raised by 200. In this embodiment, the twist cap removal portion (202) of the housing (207) is placed in an arched or outwardly tapered orientation extending transversely relative to an elongated central axis A-A of the open lower corkscrew portion (203) of the housing. The angle may be varied but is shown at 45° with an angle of between 10 to 90 degrees being possible. Like the embodiment of FIG. 5, there is motor (210) and a battery or other power source (220) connected to the motor through switch (204) similar to the one previously described and thus having forward and reverse buttons (204*a* and 204*b*). The motor includes a pair of drive shafts (211*a* and 211*b*). Drive shaft (211*a*) is connected by way of drive gear (212*a*) to drive a planetary gear system (238*a*) connected to drive a caliper clamp assembly (230) including a pair of movably adjustable arcuate clamps (234*a* and 234*b*), in a manner as described with respect to the embodiment of the invention shown in FIGS. 1-4. In this embodiment, the first drive shaft (211*a*) drives a tapered drive gear (212*a*) which drives an angled gear shaft (242). The angled gear shaft (242) has tapered gears (243) and (244) for engaging the tapered drive gear (212*a*) and a tapered driven gear (213) that meshes with the gears of a planetary gear system (238*a*), similar to the planetary gear systems of the previous variations or embodiments. The planetary gear system (238*b*) is connected to drive output corkscrew drive shaft (214) to which a corkscrew (240) is mounted. In this embodiment the corkscrew (240) works with retracting tube (250) which secures a cork when extracted from a bottle. Such retracting tube (250) slides along members (251) acting as guides. A spring (241) is used to retract the retracting tube (250) when in a non-use state.

Figure 7:
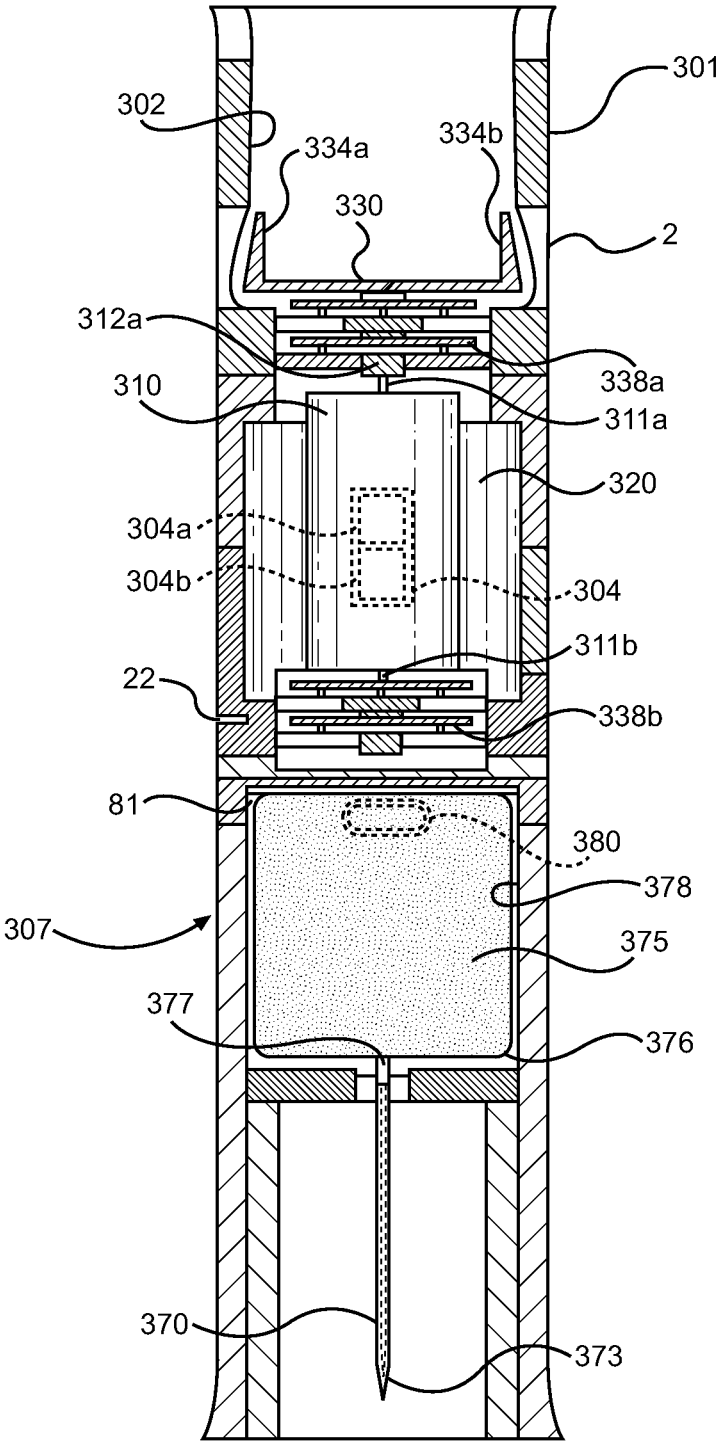
FIG. 7 is a cross sectional view of another embodiment of combined cork and twist cap remover showing a needle for injecting a gas into a bottle to eject a cork.
Figure 8:
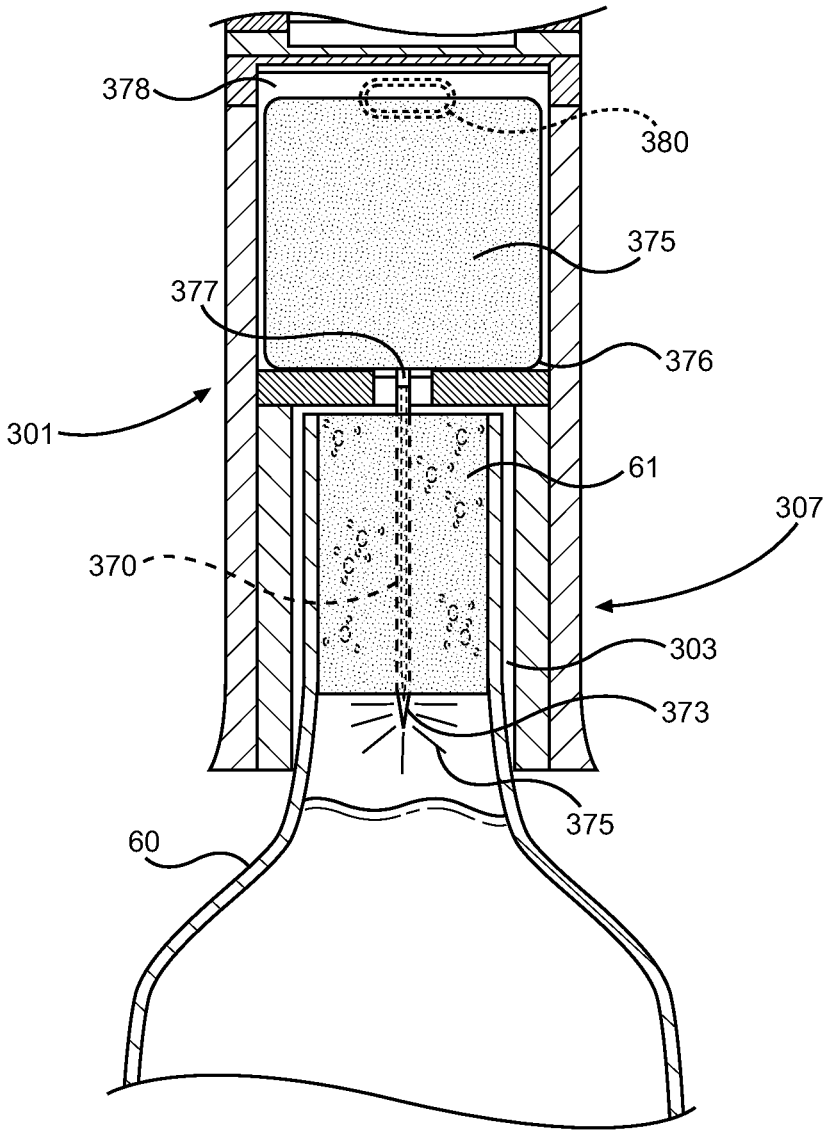
FIG. 8 is a partial cross sectional view of the embodiment of FIG. 7 with the needle being positioned through a cork closing a bottle.

Another embodiment of the invention is shown in FIGS. 7 and 8. The elements in common with the embodiment of FIG. 1 are referenced by reference numbers raised by 300. In this embodiment the combined cork and twist cap remover (301) includes a housing (307) having a twist cap removal portion (302) at one end thereof. Like the variations FIGS. 5 and 6, there is motor (310) and a battery or other power source (320) mounted within the housing and connected through switch (304) similar to the one previously described and thus having forward and reverse buttons (304*a* and 304*b*). The motor includes a pair of drive shafts (311*a* and 311*b*). Drive shaft (311*a*) is connected by way of drive gear (312*a*) to drive a planetary gear system (338*a*) connected to drive a caliper clamp assembly (330) including a pair of movably adjustable arcuate clamps (334*a* and 334*b*), in a manner as described with respect to the embodiment of the invention shown in FIGS. 1-4. Unlike the previous embodiments, the motor (310) is not connected to drive a corkscrew but is connected through a secondary planetary gear system (338*b*) similar to those previously described to an internal pump (not shown) that supplies air pressure to pressure chamber or cartridge (376). As opposed to a pressure chamber supplied by a pump, the cartridge may be a removable pressurized cartridge that is replaced when the internal pressure is not sufficient to remove a cork or stopper as will be described. Likewise the cartridge may contain a solution, which can be air, gas, or similar performing solution. The gas cartridge (376), is placed in a compartment (378) in the second end portion of the housing for holding and containing the gas cartridge (376) when used for removing a cork or stopper. The gas cartridge (376) is connected to a hollow connector pin (377) that delivers gas from the gas cartridge (376) to a hollow needle (370) mounted within the second end portion of the combined cork and twist cap remover (301). The needle is connected to the connector pin (370) and has an ejection port (373) at a pointed tip (372) thereof.

FIG. 8 is a cross sectional view similar to FIG. 7 looking into the body of the combined cork and twist cap remover (301). When and operator places a corked bottle (60) in the upright position and places the second open end portion (303) over the bottle the sharp tip of the needle is forced through the cork stopper (61), so that the ejection port (373) will communicate with the head space within the bottle. When the operator engages a lever (380), the lever pushes down on the gas cartridge (376), which releases gas (375) from the gas cartridge through the connector pin (377). The gas flows through the needle (370) and out the needle ejection port (373) and into the neck area of the bottle. The gas pressure inside the bottle pushes the cork stopper upward and out of the bottle giving the operator a quick alternate way to remove the cork.

In operation, one uses the hand-held combined cork and twist cap remover device mainly for convenience to open and release a bottle cap from a bottle as well as remove a cork-stopper from a bottle. If a person has a wine bottle with a twist cap, for example, he or she would hold the wine bottle upright in one hand and using their other hand place the first open end portion of the combined cork and twist cap remover over the bottle until the wine bottle cap is placed under the caliper clamp assembly as shown in FIG. 4. This device is automatic and powered by a power source, since the user simply holds the bottle, the combined cork and twist cap remover does the actual work of twisting off the bottle cap. For further operation, the person activates the motor to drive the mechanical gear system, which provides torque to the caliper clamp assembly. The pair of movable clamps close and eventually grip the cap of the bottle. Once enough pressure is placed on the bottle cap, the cap is twisted along the bottle treads until the cap is released from the bottle.

The same principle applies when a person has a wine bottle with a cork-stopper for example. The person holds the wine bottle upright in one hand and using their other hand places the second open end portion of the combined cork and twist cap remover over the cork bottle until the wine bottle top is place under either the corkscrew as shown in FIG. 3 or the needle as shown in FIG. 7. With a push of a switch button the power source sends power to the motor which goes into motion turning the corkscrew or the person pushes the combined cork and twist cap remover down so the needle penetrates through the cork as shown in FIG. 8. With the motor and corkscrew, as the user simply holds the bottle, the combined cork and twist cap remover does the actual work of inserting the corkscrew, lifting the cork stopper up and out of the bottle and into the retracting tube which in turn removes the cork for the bottle. With the needle embodiment, once the needle is inserted into the bottle, the user engages the lever to release pressurized gas into the bottle to force the cork or stopper from the bottle.

In addition to convenience, the combined cork and twist cap remover is helpful to those with arthritis and to the elderly that may have a difficult time opening a bottle without it.

The invention claimed is:

1. A combination cork and twist cap remover for removing closure caps and stoppers which are applied to close dispensing openings in containers, the apparatus comprising, a housing including a first open end portion of a size to be seated over a cap of a container and a second open end portion of a size to be seated over a neck of a bottle closed by a stopper, a motor mounted within the housing and having a first drive shaft, a power source mounted within the housing, switch means mounted to the housing for selective connecting the power source to the motor, a caliper clamp assembly mounted within the first end portion of the housing including jaws which are movable relative to one another between a first position wherein the jaws are spaced from one another to a second position wherein the jaws engage the cap of a container when the first end portion of the housing is seated over the cap of the container, a first gear assembly for connecting the first drive shaft to the caliper clamp assembly to open and close the jaws relative to the cap of the container whereby when the jaws are engaged with the cap, further operation of the motor to rotate the first drive shaft will cause the jaws to rotate the lid relative to the container to remove the cap from the container, a stopper removal means mounted within the second open end portion of the housing, the stopper removal means including an element for penetrating the stopper to remove the stopper from the bottle when the second open end portion of the housing is seated over the stopper of the bottle.

2. The combination cork and twist cap remover of claim 1 wherein the motor is a reversibly drive motor such that the first drive shaft may be rotated in opposite directions by manipulation of the switch means.

3. The combination twist cork and twist cap remover of claim 1 wherein the stopper removal means includes a corkscrew mounted within the second end portion of the housing, the motor having a second drive shaft, a second gear assembly being connected between the second drive shaft and the corkscrew for rotating the corkscrew within the second open end portion of the housing whereby when the second open end portion of the housing is placed over the stopper and neck of the bottle and the motor activated by the switch means, the corkscrew penetrates into the stopper and urges the stopper from the neck of the bottle.

4. The combination cork and twist cap remover of claim 3 wherein the motor is a reversibly drive motor such that the first drive shaft may be rotated in opposite directions by manipulation of the switch means.

5. The combination cork and twist cap remover of claim 4 wherein the first and second open end portions of the housing are generally axially aligned with one another and oriented in opposite directions.

6. The combination cork and twist cap remover of claim 3 wherein the first and second open end portions of the housing are generally axially aligned with one another and oriented in opposite directions.

7. The combination cork and twist cap remover of claim 3 wherein the first and second open end portions of the housing are generally transversely oriented relative to one another.

8. The combination cork and twist cap remover of claim 7 a first gear connected to the first drive shaft and a second gear connected to an input shaft to the first gear assembly, and a linking drive shaft extending between the first and second gears.

9. The combination cork and twist cap remover of claim 8 wherein the motor is a reversibly drive motor such that the first drive shaft may be rotated in opposite directions by manipulation of the switch means.

10. The combination cork and twist cap remover of claim 3 wherein the first and second open end portions of the housing are oriented in generally the same direction and are generally parallel with one another.

11. The combination cork and twist cap remover of claim 10 wherein the motor is a reversibly drive motor such that the first drive shaft may be rotated in opposite directions by manipulation of the switch means.

12. The combination cork and twist cap remover of claim 10 including a first gear connected to the first drive shaft and a second gear connected to an input shaft to the first gear assembly, and a linking drive shaft extending between the first and second gears.

13. The combination cork and twist cap remover of claim 1 wherein the stopper removal means includes a pressure source mounted within the housing, the element for penetrating the stopper being a hollow needle having a discharge opening adjacent a tip thereof, the needle being in communication with the pressure source, and operating means for supplying pressure from the pressure source when the discharge opening has penetrated the stopper and is oriented within the bottle, such that pressure introduced into the bottle through the needle forces the stopper into the second open end portion of the housing.

14. The combination cork and twist cap remover of claim 13 wherein the motor is a reversibly drive motor such that the first drive shaft may be rotated in opposite directions by manipulation of the switch means.

* * * * *